United States Patent [19]

Crandall et al.

[11] Patent Number: 4,681,033

[45] Date of Patent: Jul. 21, 1987

[54] DRIVE SYSTEM FOR BELT PRESS

[75] Inventors: Robert E. Crandall, Greendale; Kenneth F. Kosulic, Mukwonago; Thomas C. Rooney, Waukesha; Larry C. Smith, New Berlin, all of Wis.

[73] Assignee: Rexnord Inc., Brookfield, Wis.

[21] Appl. No.: 871,948

[22] Filed: Jul. 23, 1986

Related U.S. Application Data

[62] Division of Ser. No. 680,614, Dec. 11, 1986, Pat. No. 4,622,894.

[51] Int. Cl.[4] ..... B30B 5/06

[52] U.S. Cl. ..... 100/118; 100/151; 210/386; 210/401

[58] Field of Search ..... 100/118, 119, 120, 151, 100/152, 153, 154; 210/386, 396, 400, 401; 162/360.1; 198/813

[56] References Cited

U.S. PATENT DOCUMENTS 4,007,826 2/1977 Brown, Jr. et al. ..... 198/813

4,159,947 7/1979 Brooks et al. ..... 100/118 X 4,181,616 1/1980 Bahr ..... 100/118 X 4,492,155 1/1985 Wolkenstein ..... 100/118

*Primary Examiner*—Peter Feldman

*Attorney, Agent, or Firm*—Lawrence J. Crain

[57] ABSTRACT

In a belt press of the type used to dewater heavy slurries, an improved belt drive system is provided. The upper belt is driven by at least two rollers, one of which is situated in the dewatering section wherein the upper and lower belts are squeezed and traveling together. The improved drive arrangement provides a more uniformly increasing tension in the belt as it passes through the dewatering section than in such presses heretofore. Further because the lower belt is at least partially driven by its frictional engagement with the upper belt, through the sandwiched slurry, the synchronization of the belt speeds is improved. Further improved control of the belt press performance is provided by means for sensing the speeds of the belts and responsive means for regulating the belt tensioning systems accordingly.

3 Claims, 5 Drawing Figures

DRIVE SYSTEM FOR BELT PRESS

This application is a division, of application Ser. No. 680,614, filed 12/11/84 now U.S. Pat. No. 4,622,894.

BACKGROUND OF THE INVENTION

The present invention relates in general to belt presses for dewatering slurries, and in particular to an improved drive and belt synchronizing system for such belt presses.

Belt presses generally consist of a frame having a slurry-receiving end and a slurry-discharge end and supporting several rolls or rollers of varying diameters mounted parallel to each other and transversely to the flow direction of the slurry through the frame. At least one and often two or more porous endless belts are supported by these rolls and, in multiple belt presses, each belt is associated with a specific set of rolls usually to perform a specific phase of the slurry dewatering process. In two-belt presses, an upper belt is normally positioned to travel a loop above the loop traveled by a lower belt. Most presses include a pressurized dewatering section, where two belts travel together with a layer of slurry andwiched between them in a serpentine path over and under a generally horizontal series of wringing rolls of varying diameter. It is well established that belts are subject to increased tension and consequently increased dewatering pressure as the diameter of the wringing roll decreases.

In operation, a slurry having a relatively low solids content is deposited on the upper belt at the slurry-receiving end of the press, where means for draining free water are provided. The remaining solids are transported to the dewatering section, where the gradually increasing tension on the belts serves to wring most of the water from the slurry, leaving a dry cake which is scraped off the belt with a doctor blade.

Heretofore, it has been the usual procedure to power each belt by a drive roll positioned at the slurry discharge end in order to pull the belt through the dewatering section. U.S. Pat. Nos. 3,699,881 to Levin, et al. and 3,894,486 to Sparowitz, et al. describe two-belt presses in which the belts are driven in this manner.

In prior art presses using conventional drive means, the upper belt frequently moves slower than the lower belt due to a loss of tension from the heavier dewatering load under which it operates. Once a speed differential is established between the belts, there is a tendency for that differential to increase over time, thus lowering the dewatering efficiency of the press. It has also been observed that the upper and lower belts often slip against each other as they travel the serpentine path over and under the wringing rollers as a result of the above-mentioned load differential as well as the fact that each belt is alternately subjected to higher tension as it travels over one roll on top of the other belt, then slightly less tension as it passes directly against the next roll, with the other belt on top of it.

An often-encountered problem with prior art presses used to dewater slurries generated by coal mining is that as the slurry is dewatered, the concentrated solids form cakes of nonplastic material. This causes a phenomenon known as "lockup", wherein the dewatered material becomes lodged between the two belts preventing them from sliding against each other. In a "lockup" situation, since the belts cannot slip against each other, they are forced to compensate for the press's inherent difference in belt tension by either stretching or bunching up. If a hard or sharp piece of slurry material becomes "locked-up", it will cut belt fibers as it forces them against the hard surface of the steel pressure rolls. Also, when the "lockup" is released, it has been observed that one of the belts will jump or jerk back into a more normal condition. This phenomenon is known as "popping". These resulting conditions increase belt wear and significantly decrease the efficiency of the dewatering section to the point where the last high pressure roller performs most of the dewatering. Moreover, this problem is aggravated by the above-mentioned relative speed differentials between the two belts.

In prior art presses using two drive rolls, one for each belt, to essentially pull the belts through the high pressure dewatering section of the press, the drive rolls are normally covered with rubber or a similar elastomer to enhance the driving friction between the belts and the rolls. In order to compensate for the "lockup" problem, and to prevent belt wear, the normally uncovered steel interior rolls are sometimes fitted with a plastic coating designed to alleviate the lockup problem by encouraging the belts to slip against the rolls, thus preventing belt stretch and wear.

A drawback of this system is that any slippage of the belts, either against the other belt or against a steel roll, will increase instead of decrease belt wear. An additional drawback of this method is that the plastic coating is not as compressible as rubber, and as it wears through it breaks up into sharp edges which cut the belt. Prior art presses were not able to cover the pressure rolls with elastomeric material because the friction caused by inherent belt slippage tended to wear away the elastomeric covering.

A further deficiency of prior art presses is their inability to compensate for solids having varying degrees of plasticity; for example, the more plastic the dewatered solid is, the more relative slippage is permissible between the belts.

Accordingly, a principal object of the present invention is to provide an improved belt press drive wherein the dewatering pressure increases along a more uniform gradient throughout the dewatering section.

A further object of the present invention is to provide a belt press drive wherein "lockups", the resulting popping and consequential belt wear and slippage are minimized.

A still further object of the present invention is to provide a belt speed monitoring and tension control system which regulates belt tension to keep both belts moving at generally the same speed through the dewatering section.

SUMMARY OF THE INVENTION

A belt press is provided for dewatering a slurry which includes: a frame having a slurry-receiving end and a slurry-discharge end supporting two sets of rolls each of which is mounted parallel to the other and transversely to the flow direction of the slurry through the frame; and upper and lower porous endless belts, each supported by a corresponding set of rolls and belt tensioning means. Each of said belts travels in a generally horizontally flattened loop around a particular set of rolls, with the loop of the upper belt positioned directly over the loop of the lower belt so that the lower span of the upper belt and the upper span of the lower belt travel together in a contiguous, sandwiched relationship through a dewatering zone along a generally serpentine path over and under vertically staggered rolls arranged in a low pressure section followed by a high pressurer section of relatively smaller diameter rolls. In this arrangement, the pressure exerted on the slurry gradually increases toward the slurry-discharge end and the slurry is progressively dewatered as it travels through the press.

An important improvement of the present invention over prior art presses includes driving the upper belt by at least two rotary powered drive rolls, one of which is positioned near the slurry-discharge end of the press in the conventional fashion, and at least one other of which is positioned among the high pressure rolls in the dewatering section.

In a preferred embodiment, the second drive roll is positioned as the first smaller diameter high pressure roll encountered by the belts after passing through the low pressure dewatering section. The use of at least one additional drive roll on the upper belt serves to smooth the buildup of tension in the upper belt, making it easier to synchronize with the lower belt, and in so doing ensures that the belt/slurry sandwich will be exposed to gradually increasing dewatering pressure as it progresses toward the slurry-discharge end.

In the preferred embodiment, particularly when the press is designed to handle only non-plastic slurries, the lower belt is not provided with a drive roll but is pulled through the press by the upper belt, via friction through the sandwiched slurry. However, rolls on the lower belt may be provided with drive means when plastic slurries are to be processed.

By applying additional power to the upper belt, the previously encountered problems of "lockups" and belt popping are eliminated. Since the endless belts are traveling at the same speed and tension, the tendency to stretch or slip against each other is greatly reduced, and the useful life of the belts is prolonged.

The belt press of the present invention further provides a belt speed monitoring system which automatically adjusts belt tension to keep the belt speeds synchronized, compensating for inevitable belt stretching.

The invention and its many attendant objects and advantages will be better understood upon reading the following description of the preferred embodiment in conjunction with the following drawings.

DESCRIPTION OF THE PREFERRED EMBODIMENT

Figure 1:
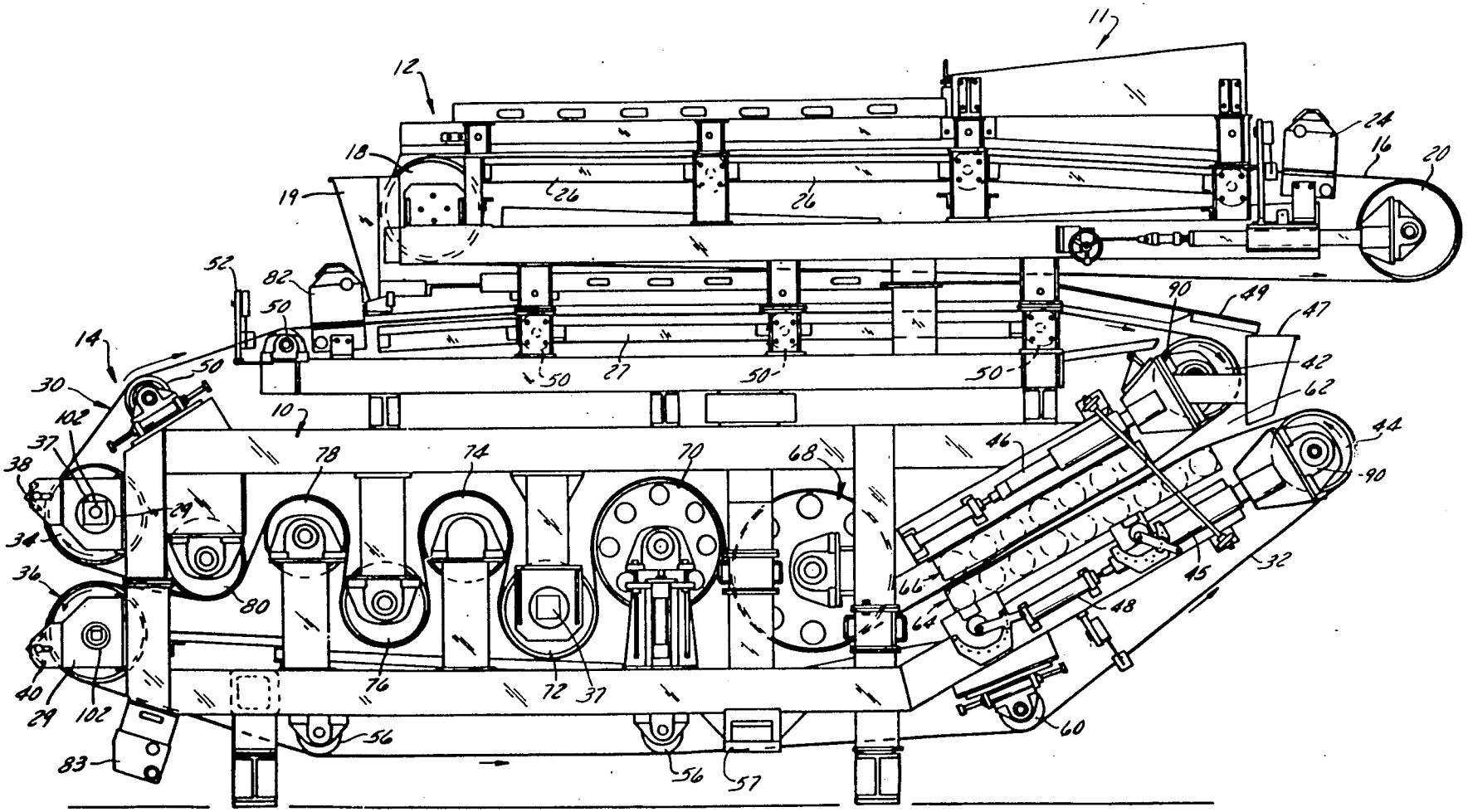
FIG. 1 is a side elevation of a belt press made in accordance with this invention.
Figure 2:
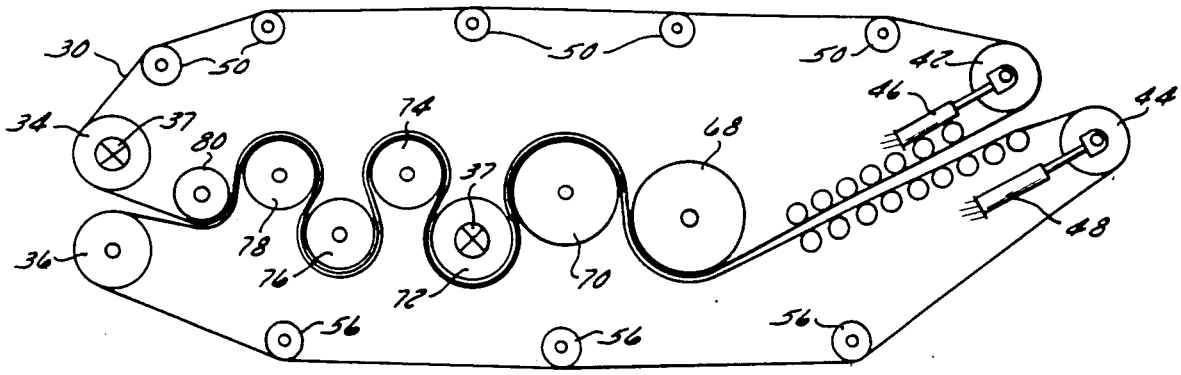
FIG. 2 is a schematic view of the belt loops and rolls according to the present invention designed to demonstrate the forces acting on the belt at various points.

Referring to FIG. 1, a belt press embodying the present invention is shown. For clarity, the end of the belt press to the right in FIG. 1 will be referred to as the "slurry-receiving" end, and the end to the left will be referred to as the "slurry-discharge" end. For the purpose of this discussion, the machine is generally symmetrical about a vertical plane containing the longitudinal axis of the machine, parallel to the plane of FIG. 1.

The belt press has a frame 10 with an upper deck 12 and a lower deck 14, the upper deck 12 including a single belt 16 which is driven by a drive roll or roller 18 and is tensioned by a tensioning roll 20. The belt 16 is supported on a grid 26 made of polymeric material such as a filled polyester. It is possible to operate the belt press lower deck 14 without an upper deck 12 in which case the slurry would be introduced directly onto the lower deck by means of a distribution box similar to the box 11 shown on the upper deck 12.

The lower deck 14 includes an upper belt 30 which, in accordance with this invention is driven by two drive rolls 34 and 72. While certian sludge types may call for at least one of the rolls in engagement with the lower belt to be driven, in the preferred embodiment, the lower belt 32 is driven only by means of friction between it and the upper belt through the interdispersed slurry. The belts are fine weave, endless polymeric mesh belts. The drive motors are hydraulic or electric motors 37 mounted directly on mounting brackets 29 projecting rearwardly from the frame, and are coaxial with the bearings for the rolls. The motors 37 drive planetary gear reduction units. Doctor blades 38, 40 are provided to scrape the dewatered dry cake off the belts.

Two tensioning rolls 42, 44 are provided at the slurry-receiving end of the press for tensioning the belts 30 and 32, respectively. The tensioning rolls 42 and 44 exert an adjustable uniform tension on the belts 30 and 32 by a tensioning system 45 which includes two hydraulic cylinders 46 and 48. The tensioning system will be described in greater detail below.

The upper belt 30 is supported along its top run by four small top rolls 50 which hold the belt off the grids 27 when there is no slurry on the belt.

Similarly, the lower run of the lower belt 32 is supported by small rolls 56 which hold the belt downward to clear a lower drain trough 57. The tensioning rolls 42 and 44 form the upper forward end of a wedge section 62. The belts 30, 32 enter the wedge section at a given gap or separation and then are gradually brought closer together by a pair of opposed racks of rolls 64 and 66, which begin pressing the liquid from the slurry. The position of the racks of rolls 64 and 66 can be adjusted vertically, axially and angularly in order to achieve maximum dewatering.

After the belts 30 and 32 have passed out of the exit end of the wedge section 62, they move together in a serpentine path over a set of large rolls, beginning with two perforated or grooved rolls 68, 70. The perforated rolls 68 and 70 have holes along their cylindrical surfaces and at their ends to facilitate drainage. Rolls 68 and 70 are hereinafter referred to as the low pressure rolls, because of the low amount of dewatering pressure they exert on the belt relative to the next five rolls, 72, 74, 76, 78 and 80, which are of smaller diameter, and which are known as the high pressure rolls.

An important feature of the present invention is the installation of second drive motor on the first high pressure roll 72 to smooth the buildup of tension in the upper belt 30 through the dewatering zone.

The motor 37 at roll 72 serves to give the upper belt a boost as it enters the high pressure section, ease the load on the first drive roll, and consequently match it with the tension of the lower belt.

Belt slippage is reduced by covering rolls 72, 74, 76, 78 and 80 with rubber or a similar elastomeric substance. Aside from enhancing the traction of belts on the rolls, the elastomeric covering acts as a cushion which allows the belts to "give" when a sharp hard piece of slurry material becomes lodged in the dewatering sandwich.

The operation of the belt press is as follows: The slurry is pumped into distribution box 11, which spreads it evenly over the upper deck belt 16. The upper deck belt 16 travels in a counterclockwise direction around the rolls 18, 20 as shown in FIG. 1, and carries the slurry along the top run of the belt toward the drive roll 18, with water freely draining through the belt along the way. The water is caught and conveyed away by a drain system. When the slurry reaches the slurry-discharge end of the upper deck belt 16, which is at roll 18, it drops through a trough 19 onto the top of the upper belt 30 just to the right of a belt washer 82. The run of the belt 30 is moving to the right in FIG. 1, so the slurry reverses its direction, tumbles slightly, which promotes water separation, and continues to drain freely as the upper belt 30 moves back toward the slurry-receiving end of the press. When the slurry reaches the slurry-receiving end of the press at the tensioning roll 42, it is guided by a fence 49 into a trough 47 which funnels the slurry into the entry end of the wedge section 62 between the belts 30 and 32. The slurry is carried through the wedge section 62 of the press, where additional water is gradually pressed out between the conveying belts 30 and 32 by the upper and lower racks of rolls 64 and 66 which apply gradually increasing pressure to the slurry.

When the slurry emerges at the exit end of the wedge section 62 between the belts 30 and 32, it is firmly compacted into a moist cake. The cake is then carried by the belts in a serpentine path over and around the rolls 68, 70, 72, 74, 76, 78 and 80, where it is subjected to shear by virtue of the multiple changes of direction, and also to gradually increasing pressure. When the belts emerge from the slurry-discharge end at rolls 34 and 36, the cake is dry and is scraped from the belts by means of the doctor blades 38 and 40. The belts 30 and 32 are then backwashed by the belt wash units 82 and 83 and the process continues with the upper belt 30 returning underneath the trough 19 to pick up more of the slurry, and the lower belt 32 returning forward under the machine back to the entry end of the wedge section 62.

An important feature of the present invention is the advantageous placement of a second drive roll in the high pressure dewatering section to increase tension on the normally sluggish upper belt. Although the second drive roll could be any of the high pressure rolls which directly contact the upper belt (72, 76 or 80), the best dewatering results have been observed when roll 72 is the driven roll.

The exact reasons for this are unclear, however, a logical explanation is that at roll 72 the upper belt is halfway between the tensioning roll 42 and drive roll 34. The tremendous work load on that latter roll may cause rolls 72, 70 and 68 to be subject to some dilution of that driving force. Thus, roll 72 is located where the upper belt would be prone to "lockups" and resulting stretching or popping.

Figure 3:
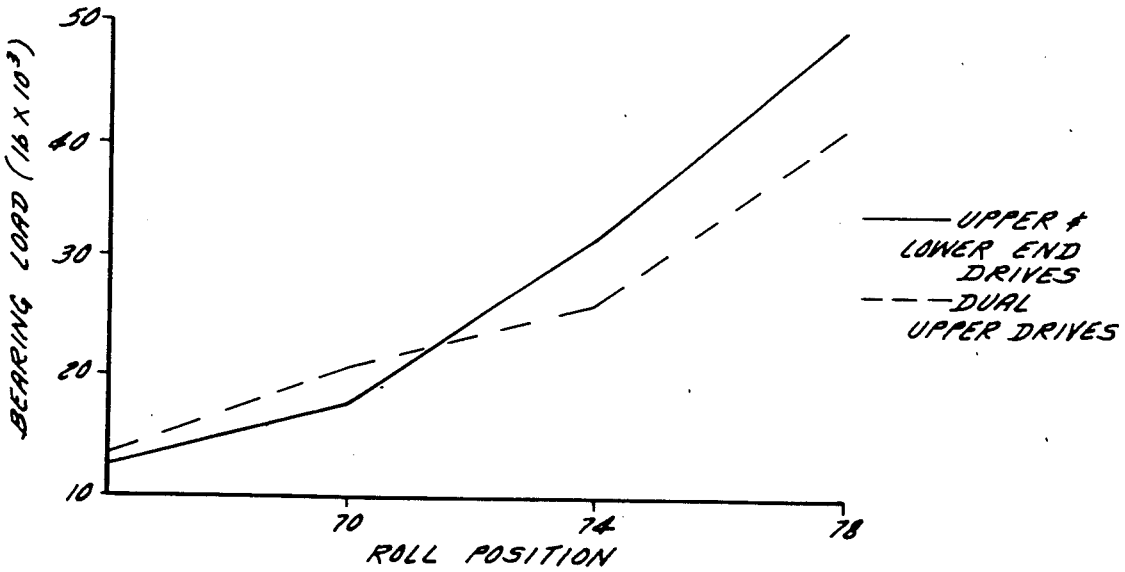
FIG. 3 is a graphic representation of a comparison of roll bearing load on a belt press using different belt drive arrangements.

FIG. 3 reflects the results of a comparison test of roll bearing loads on the same belt press, using two types of belt drive arrangements; the first, where drive means were attached to upper and lower belt rolls located at one slurry-discharge end in the conventional fashion (solid line), and the second, where drive means were attached to two rolls on the upper belt, one at the slurry discharge end, and the other at roll 72 in the dewatering section (dashed line). Bearing loads, measured in pounds of roll load were comparatively low in the low pressure section, but then rose fairly rapidly in the high pressure section near the slurry-discharge end. When the drive system of the present invention is used, bearing load is distributed in a more uniform manner, with higher load in the low pressure section, possibly due to the additional tensioning provided by the second drive roll. In the high pressure section, the advantages of the present system become more evident, for bearing load was reduced almost 20% under the conventional system.

The preferred embodiment of the present invention is designed for the dewatering of coal mining or mineral slurry, which results in a relatively non-plastic dewatered material. Maximum dewatering was obtained in this situation by mounting two drive motors on the upper belt 30 at point 72 and 34, while omitting any independent power source for the lower belt 32.

Although prior art belt presses include drive means for the lower belt, in the present invention the lower belt is carried through the press by friction created between the upper belt and the lower belt through the relatively non-plastic dewatered material in between. Should the present invention be used to dewater a material with substantially less plasticity, dewatering action could be increased by changing the location or arrangement of the drive rolls such as connecting an additional drive unit to the roll 36, associated with the lower belt and located at the slurry-discharge end.

Figure 5:
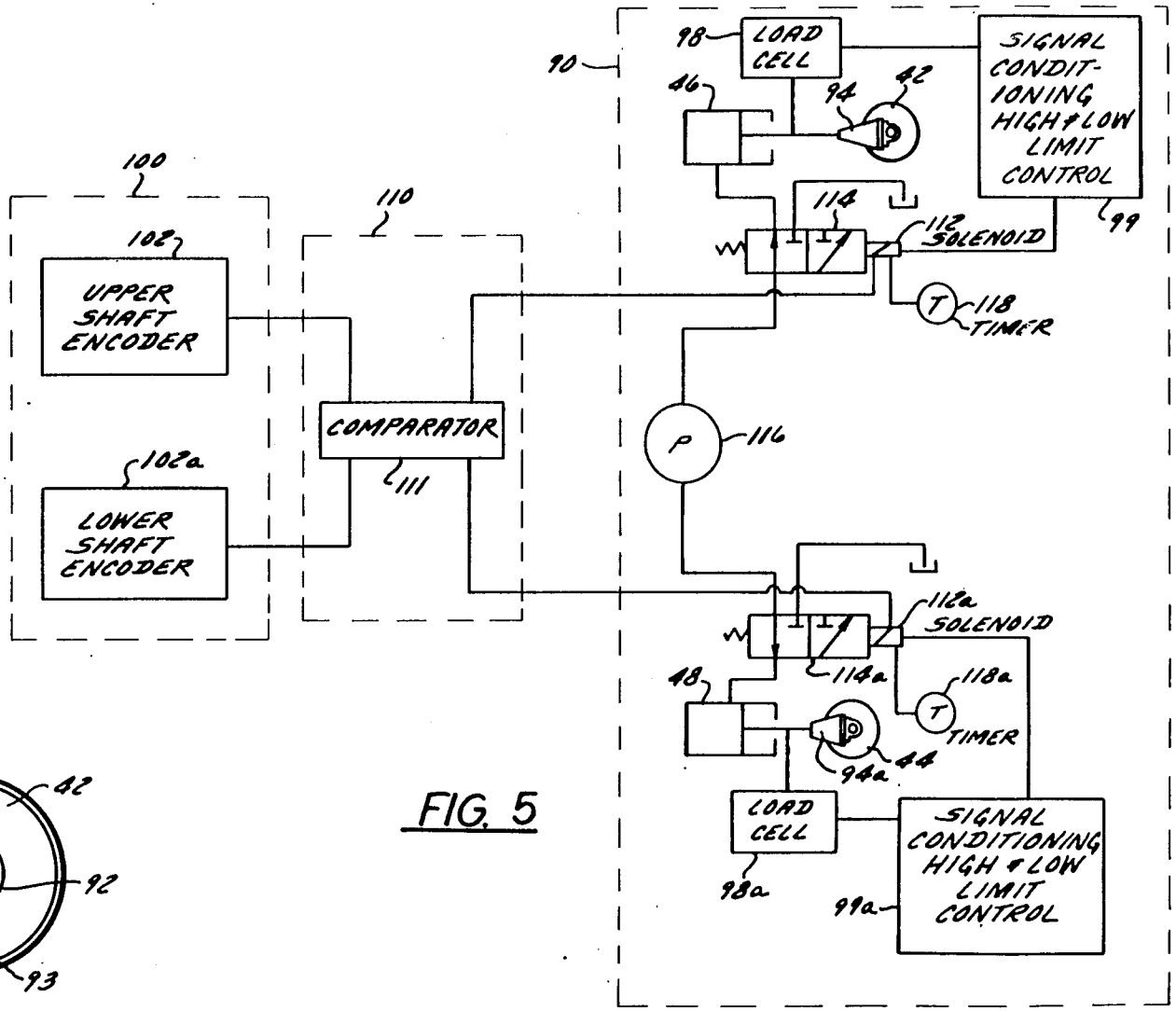
FIG. 5 is a schematic representation of the belt speed monitoring and belt tension adjusting control system.

An additional feature of the present belt press is the use of belt speed sensing means in conjunction with belt tension regulating means to provide a belt tension monitoring system which ensures that the relative speeds of the upper and lower belts are held within pre-selected ranges. This system enables the press to automatically "fine tune" belt tension on a continuing basis to optimize dewatering. Referring to FIG. 5, the system is comprised of an upper and lower belt tension regulating portion 90, an upper and lower belt speed sensing portion 100, and a comparator circuit portion 110, each of which will be separately described below.

Since the belt tension regulating apparatus 90 is essentially identical for the upper and lower belts, for the sake of simplicity the following explanation will describe the apparatus for the upper belt only.

Figure 4:
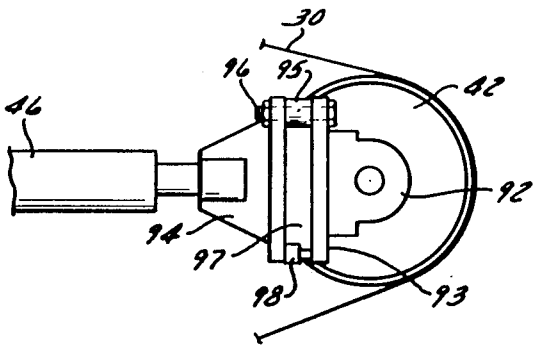
FIG. 4 is an enlarged side elevation of the belt tension overload sensing apparatus shown in FIG. 1.

Referring to FIG. 4, the belt tension regulating apparatus 90 is located adjacent to and directly involving tension roll 42. The bearings for roll 42 are located in pillow block 92 having a base plate 93 connected at one end to a tensioning rod bearing support 94 by means of a rigid spacer 95 and a fastener 96 such as a threaded bolt. This assembly creates a gap 97 at the free end of the base plate 93 into which a load cell 98 is placed to measure the deflection of base plate 93 in response to changes in belt load on roll 42. The load cell 98 transmits signals to the high and low limit control circuit 99 which in turn triggers a solenoid 112. Belt tensioning is altered by means of the solenoid 112 which controls the flow of hydraulic fluid to hydraulic cylinder 46 connected to the tensioning rod bearing support 94.

The belt speed sensing portion 100 consists of shaft encoders 102 and **102*a* mounted on the hubs of rolls 34 and 36**.

Referring to FIG. 5, the comparator portion 110 consists of a comparator circuit 111 which receives signals from the shaft encoders 102, measures the differential between belt speeds, compares that differential against a pre-set limit and activates the belt tension regulating portion 90 to ensure that belt speeds are maintained in a synchronized arrangement within the pre-set limits.

If the comparator portion 110 determines that the belt speed differential exceeds the pre-set limit, it activates the belt tension regulating portion 90 for the faster belt. In the case of the upper belt, signals from the comparator trigger the solenoid actuator 112 which operates hydraulic valve 114 to release pressure in a hydraulic pressure line connecting pump 116 to the hydraulic cylinder 46 which in turn operates the tensioning rod bearing support 94 to retract roll 42 and relieve tension on the belt. The tension of the lower belt is similarly regulated by solenoid actuator 112*a*, hydraulic valve 114*a*, tension rod bearing support 94*a* and roll 44. The solenoid actuators normally cycle between pre-set high and low belt tension limits measured as bearing load by the load cell 98, an alternative would consist of presetting the load cell to respond to a high belt tension limit, and having the upper and lower belt solenoid actuators 112 and 112*a* connected to cycle timers 118 and 118*a* to regulate the retard or delay time of the actuators to pull rolls 42 and 44 back from their retracted positions.

When the press is in operation, the upper belt becomes subject to varying loads and its tension may vary relative to the lower belt. This tension differential leads to a variance in belt speeds and disrupts the desired gradual pressure gradient through the dewatering section of the press, the importance of which has been described above in great detail. For this reason the present press also monitors belt tension independently of the above-mentioned comparator circuit.

Any change in upper belt tension will affect the stress on roll 42 which will be transmitted to its bearing pillow block 92 and be sensed as deflection by the load cell 98. If the load cells detect change in belt tension or bearing load reflected in deflection of the steel plate 93 from the tensioning rod bearing support 94 and the change exceeds pre-set limits, the high and low limit control 99 signals the solenoid actuator 112 to relieve pressure on the hydraulic cylinder 46 which releases tension on the belt by allowing roll 42 to retract. In cases where only a high limit control is employed, the optional timer 118 signals the solenoid to return the roll 42 back to its preset level within a preset period of time. Bearing load on the lower belt is adjusted in a similar manner.

By monitoring individual belt tension as well as regulating upper and lower belt speeds and coordinating belt speed by belt tension, the present belt press is better able to automatically optimize the dewatering process on a continual basis. Thus, as slurry solid content varies or the belts stretch due to normal wear, the upper and lower belt speeds are kept synchronized and travel within optimal preset speeds.

Modifications and variations of the disclosed embodiment will occur to those skilled in the art in view of the disclosure and the prior art. Accordingly, it is expressly to be understood that these modifications and variations, and the equivalents thereof, may be practiced while remaining within the spirit and scope of the invention as set forth in the following claims.

What is claimed is:

1. In a belt press, such as for use in dewatering a non-plastic slurry, which includes a frame having a receiving end and a discharge end, a pair of endless foraminous belts disposed in generally horizontally-flattened loops one above the other and supported on laterally-extending rolls mounted on the frame, and a series of laterally-extending pressure rolls also mounted on the frame and forming a dewatering section, said dewatering pressure rolls comprised of larger-diameter pressure rolls comprising a first low pressure section, and relatively smaller-diameter pressure rolls comprising a second high pressure section wherein the non-plastic slurry is deposited upon one of the belts, that belt becoming the loaded belt, and adjacent spans of the belt loops are adapted to sandwich the slurry between them and travel together from the receiving end to the discharge end of the press along a serpentine path over and under the low and high pressure dewatering rollers to effect gradually progressive dewatering of the slurry, the improvement comprising:

a first power-driven roll situated at the discharge end of the dewatering section in direct driving engagement with the loaded belt;

at least one additional power-driven roll situated within the high pressure dewatering section in direct driving engagement with the loaded belt, said drive rolls being effective in combination to pull the loaded belt through the high and low pressure dewatering sections with a uniform gradual increase in the tension in the loaded belt as it moves through said dewatering section; and wherein the non-loaded belt is driven only by frictional engagement with the loaded belt through the progressively-thickened non-plastic slurry.

2. A belt press as defined in claim 1, wherein said additional power driven roller is the first pressure roller in the high pressure section.

3. A belt press, particularly suited for dewatering a slurry such as a coal slurry, comprising:

a pair of endless, foraminous belts formed into generally horizontally-flattened loops one above the other and supported by laterally-extending rolls mounted in a frame, said coal slurry being deposited upon said upper belt;

a plurality of pressure rolls arranged parallel to each other laterally across and through the belt loops in a series comprising a first low- pressure exerting dewatering section followed by a second high-pressure exerting dewatering section through which the juxtaposed spans of said upper and lower belt loops travel together with slurry sandwiched between them along a tortuous path over and under said pressure rolls to effect a gradually progressive dewatering of the slurry;

at least two power driven rolls in direct driving engagement with the upper belt, one of said driven rolls being located at the end of the dewatering section and the other being located at the first high-pressure roll in the series of pressure rolls, said driven rolls being effective to pull the upper belt through the dewatering section with a substantially steady increase in the tension of the upper belt as it moves through the dewatering section, and said lower belt being pulled through said dewatering section only by frictional engagement with said upper belt and through said coal slurry sandwiched between said belts.

4. A belt press as defined in claim 3 wherein said coal slurry is partially dewatered prior to its deposition on the upper belt.

5. A belt press as defined in claim 1 wherein said loaded belt is the upper belt.

* * * * *